US007583167B2

(12) United States Patent
Celinski et al.

(10) Patent No.: US 7,583,167 B2
(45) Date of Patent: Sep. 1, 2009

(54) HIGH FREQUENCY MAGNETIC THIN FILM FILTER

(75) Inventors: Zbigniew J. Celinski, Colorado Springs, CO (US); Robert E. Camley, Colorado Springs, CO (US)

(73) Assignee: The Regents of the University of Colorado, Boulder, CO (US)

( * ) Notice: Subject to any disclaimer, the term of this patent is extended or adjusted under 35 U.S.C. 154(b) by 802 days.

(21) Appl. No.: 11/076,132

(22) Filed: Mar. 9, 2005

(65) Prior Publication Data

US 2005/0212625 A1 Sep. 29, 2005

Related U.S. Application Data

(60) Provisional application No. 60/551,578, filed on Mar. 9, 2004.

(51) Int. Cl.
*H01P 7/00* (2006.01)
*H01P 3/08* (2006.01)

(52) U.S. Cl. ..... 333/219.2; 333/205

(58) Field of Classification Search ..... 333/202, 333/204, 205, 185, 188, 219.2
See application file for complete search history.

(56) References Cited

U.S. PATENT DOCUMENTS 5,568,106 A 10/1996 Fang et al.
6,414,564 B1 * 7/2002 Mizoguchi et al. ..... 333/35

OTHER PUBLICATIONS

J. Su, C. S. Tsai, and C. C. Lee, "Determination of Magnetic Properties of Ultrathin Iron Films Using Microwave Stripline Technique," J. Appl. Phys. 87, 5968 (2000).

N. Cramer, D. Lucic, R. E. Camley, and Z. Celinski, "High Attenuation Tunable Microwave Notch Filters Utilizing Ferromagnetic Resonance," J. Appl. Phys. 87, 6911 (2000).

A. L. Adenot, O. Acher, T. Taffary, P. Queffelec, and G. Tanne, "Tuneable Microstrip Device Controlled by a Weak Magnetic Field Using Ferromagnetic Laminations," *J. Appl. Phys.*, 87 6914 (2000).

N. Cramer, D. Lucic, D. Walker, R. E. Camley, and Z. Celinski, "Incorporation of ferromagnetic metallic films in planar transmission lines for microwave device applications," IEEE Trans. Magn., 37, 2392 (2001).

E. Salahun, G. Tanne, P. Queffelec, M. Le Floch, A.L. Adenot and O. Acher, "Application of Ferromagnetic Composite In Different Planar Tunable Microwave Devices," Microwave and Optical Technology Letters, 30, 272 (2001).

(Continued)

*Primary Examiner*—Benny Lee
*Assistant Examiner*—Kimberly E Glenn
(74) *Attorney, Agent, or Firm*—Townsend and Townsend and Crew LLP

(57) ABSTRACT

A layered microstrip device is described, in which at least two layers of different high internal field/high resonance frequency materials serve as the active elements of the device. The device is designed to filter ranges of high frequency electromagnetic waves, and is on a small scale to enable integration with high frequency electronics. The ranges of frequencies to be filtered depend on the active elements and device geometry selected for the device. The tradeoffs regarding active material and device geometry choices are explored in detail. The ranges of frequencies to be filtered can be modified in real time with the application of an external magnetic field. A variety of the devices were fabricated, and a number of experimental and theoretical studies were carried out.

20 Claims, 10 Drawing Sheets

OTHER PUBLICATIONS

C. Lee, W. Wu, C. Tsai, "Ferromagnetic resonance and microstructural studies of Ag/Fe-GaAs waveguide structures," J. Appl. Phys., 91, 9255 (2002).

E. Salahun, P. Queffelec, G. Tanne, A. L. Adenot and O. Acher, "Correlation Between Magnetic Properties of Layered Ferromagnetic/Dielectric Material and Tunable Microwave Device Applications", J. Appl. Phys., 91, 5449, (2002).

Y. Zhuang, B. Rejaei, E. Boellaard, M. Vroubel, and J. N. Burghartz, "GHz Bandstop Microstrip Filter Using Patterned $Ni_{78}Fe_{22}$ Ferromagnetic Film," IEEE Microwave Wireless Components Lett., 12, 473 (2002).

A. L. Adenot, O. Acher, T. Taffary,P. Queffelec, and G. Tanne, "Tuneable Microstrip Device Controlled by a Weak Magnetic Field Using Ferromagnetic Laminations," J. Appl. Phys., 87 6914 (2000).

N. Cramer, D. Lucic, D. Walker, R. E. Camley,and Z. Celinski, "Incorporation of ferromagnetic metallic films in planar transmission lines for microwave device applications," IEEE Trans. Magn., 37, 2392 (2001).

E. Salahun, P. Queffelec, G. Tanne,A. L. Adenot and O. Acher, "Correlation Between Magnetic Properties of Layered Ferromagnetic/Dielectric Material and Tunable Microwave Device Applications", J. Appl. Phys., 91, 5449, (2002).

* cited by examiner

Figure 3

SUMMARY OF DESIGNED PERFORMANCE AND PARAMETERS VERSUS PHYSICAL PARAMETERS

| Design performance & Parameters | Physical Parametrs |
|---|---|
| Center frequency : 4 – 24 GHz | Dielectric material : $SiO_2$ |
| Pass-band 3-dB width : 3±0.5 GHz | Dielectric Thickness : 4 μm |
| Pass-band Insertion loss : 2±0.5 dB | Magnetic Film thicknesses: 70nm Fe/140nm Py |
| Pass-band Ripple ~ 0.3 dB | Filter Dimension : 3 mm X 20 μm |
| Pass-band Return loss : < - 15 dB | Housing Dimension :3.5mmX0.5 mmX25 μm |

Figure 5

COMPARISON OF EXPERIMENTAL AND THEORETICAL RESULTS FOR FMR FREQUENCIES AS A FUNCTION OF (A) LINE WIDTH AND (B) LINE LENGTH. $W$ IS IN MICROMETERS, $L$ IS IN MILLIMETERS, AND FMR FREQUENCIES ARE IN GIGAHERTZ. FOR THE THEORETICAL CALCULATIONS, WE TOOK THE THICKNESS EQUAL TO 0.3 $\mu$m. FOR PERMALLOY $\gamma = 2.85$ GHz/kOe AND $4\pi M_s = 10$ kG. FOR Fe $\gamma = 2.85$ GHz/kOe AND $4\pi M_s = 21$ kG (A) L=3.3 mm

| | | Permalloy at H = 0.08 kOe | | Iron at H = 0.58 kOe | |
|---|---|---|---|---|---|
| W | $N_y$ | FMR (exp.) | FMR (The.) | FMR (exp.) | FMR (The.) |
| 12 | 0.0413 | 6.204 | 6.22 | 15.32 | 15.60 |
| 18 | 0.0297 | 5.28 | 5.47 | 14.2 | 14.31 |
| 26 | 0.0219 | 4.87 | 4.89 | 13.3 | 13.35 |

(B) W=26 micron

| | | Permalloy at H = 0.23 kOe | | Iron at H = 0.44 kOe | |
|---|---|---|---|---|---|
| L | $N_y$ | FMR (exp.) | FMR (The.) | FMR (exp.) | FMR (The.) |
| 2.2 | 0.02187 | 5.83 | 6.04 | 12.58 | 12.38 |
| 3.3 | 0.02188 | 5.88 | 6.04 | 12.48 | 12.38 |
| 6.6 | 0.02189 | 6.38 | 6.04 | 12.68 | 12.38 |

HIGH FREQUENCY MAGNETIC THIN FILM FILTER

PRIORITY INFORMATION

This application claims priority from provisional application No. 60/551,578, filed Mar. 9, 2004.

STATEMENT REGARDING FEDERALLY SPONSORED RESEARCH OR DEVELOPMENT

The U.S. government has rights in the disclosed invention pursuant to the following grants: ARO Grant # DAAD19-00-1-0146, ARO Grant # DAAD19-02-1-0174, DOD Grant # W911N-04-1-247.

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever.

BACKGROUND

1. Field

Embodiments of the present invention generally relate to high frequency filters, and in particular magnetic filters utilizing thin films in a microstrip device.

2. Description of the Related Art

This invention is primarily directed to communications using frequencies in the 5-100 GHz range. This area encompasses the higher frequencies associated with the microwave range, and the lower frequencies associated with the millimeter range. This range of the spectrum is currently being used, but the current uses are not taking full advantage of this resource. This under utilization exists for a variety of reasons, related both to policy and technology. Limitations in the component technology are a critical obstacle to better utilization of the higher spectra. Many of these technical problems have been or will soon be solved. The novel approach of this invention is one such advancement, and could lead to far better utilization of the frequencies at issue.

The growing interest in this area of the spectrum comes from two important factors. First, the radio and lower frequency microwave portions of the spectrum (i.e. lower frequencies) are significantly overcrowded. Second, the optical/infrared portions of the spectrum (i.e. higher frequencies) suffer significant absorption problems with fog, dust, smoke, and other atmospheric attenuation. The 5-100 GHz range thus occupies something of a sweet spot between these areas. There are other important advantages as well. Small wavelengths enable smaller components, and the high frequencies can provide very high information rate capabilities. However, such waves are not as "robust" as the radio and lower frequency microwave portions of the spectrum, suffering certain attenuation and penetration issues.

Modern communication systems that operate in the 5-100 GHz range, especially in satellite and mobile communications, require high performance filters with low insertion loss and high selectivity. Often, these criteria are fulfilled using a waveguide cavity filter or a dielectric resonator loaded cavity filter because of their low loss capabilities. However, these solutions suffer from excessive size, weight, and cost. To reduce size and cost, and improve reliability, there has been an increasing interest in planar structures.

In recent years, there has been significant progress in many areas of high frequency semiconductor electronics, and a strong movement toward the synthesis of different electronic components into integrated circuits. Initial research into filters suitable for higher frequency ranges focused largely on yttrium-iron-garnet (YIG) in physically large structures. Research has recently been expanded into magnetic MMIC (Microwave-Monolithic Integrated Circuit), using additional materials as well. The operational frequency $f$ can be estimated from the ferromagnetic resonance condition (alternatively referred to as "FMR"), and is set by material properties, such as saturation magnetization $M_s$, anisotropy fields $H_\alpha$, the gyromagnetic ratio $\gamma$, and the magnitude of an applied field H. If the applied field is along the easy axis, the frequency is given by $$f=\gamma\sqrt{(H+H_\alpha)(H+H_\alpha+4\pi M_S)},$$

and therefore the resonance frequency can be varied with an external magnetic field.

This initial research showed that there was promise in thin film magnetic structures capable of operating at higher frequencies. It also illustrated that tunability of operating frequency was possible with a change in the magnitude or orientation of an external magnetic bias. However, this research led to devices which suffered from certain limitations. YIG-based applications have relatively low resonance frequencies, and thus require large external fields to be applied in order to operate above 10 GHz, and very high external fields to operate above 20 GHz. Such large fields are incompatible with devices of a limited size since substantial electromagnets are required.

The disadvantage of YIG-based devices can be overcome with certain magnetic thin film filters that have a much higher internal field, and thus a higher operational frequency. For example, Fe has a much higher resonance frequency for the same applied field. However, its conductivity can lead to high loss at microwave frequencies. Previous work illustrates that structures utilizing thin Fe films can minimize conduction loss while still producing attenuation at certain frequency ranges. However, the maximum attenuation usually reached only about 4-5 dB/cm. This previous work was mostly limited to notch filters, and typically utilized only one layer or type of active material in each device.

Information relevant to attempts to address these problems can be found in the following Publications:

E. Schloemann, R. Tuistison, J. Weissman, H. J. Van Hook, and T. Varitimos, "Epitaxial Fe films on GaAs for hybrid semiconductor-magnetic memories," J. Appl. Phys. 63, 3140 (1988).

S. Liau, T. Wong, W. Stacy, S. Ali, and E. Schloemann, "Tunable Band-Stop Filter Based on Epitaxial Fe Film on GaAs," Proc. IEEE MTT-S IMS, 957 (1991).

J. Su, C. S. Tsai, and C. C. Lee, "Determination of Magnetic Properties of Ultrathin Iron Films Using Microwave Stripline Technique," J. Appl. Phys. 87, 5968 (2000).

N. Cramer, D. Lucic, R. E. Camley, and Z. Celinski, "High Attenuation Tunable Microwave Notch Filters Utilizing Ferromagnetic Resonance," J. Appl. Phys. 87, 6911 (2000).

A. L. Adenot, O. Acher, T. Taffary, P. Queffelec, and G. Tanne, "Tuneable Microstrip Device Controlled by a Weak Magnetic Field Using Ferromagnetic Laminations," *J. Appl. Phys.*, 87 6914 (2000).

N. Cramer, D. Lucic, D. Walker, R. E. Camley, and Z. Celinski, "Incorporation of ferromagnetic metallic films in planar transmission lines for microwave device applications," IEEE Trans. Magn., 37, 2392 (2001)

E. Salahun, G. Tanne, P. Queffelec, M. Le Floch, A. L. Adenot and O. Acher, "Application Of Ferromagnetic Composite In Different Planar Tunable Microwave Devices," Microwave and Optical Technology Letters, 30, 272 (2001).

C. Lee, W. Wu, C. Tsai, "Ferromagnetic resonance and microstructural studies of Ag/Fe—GaAs waveguide structures," J. Appl. Phys., 91, 9255 (2002).

E. Salahun, P. Queffelec, G. Tanne, A. L. Adenot and O. Acher, "Tunable Microstrip Stop-Band Function Using Absorption in Layered Ferromagnetic/Dielectric Material", J. Appl. Phys., 91, 5449, (2002).

Y. Zhuang, B. Rejaei, E. Boellaard, M. Vroubel, and J. N. Burghartz, "GHz Bandstop Microstrip Filter Using Patterned $Ni_{78}Fe_{22}$ Ferromagnetic Film," IEEE Microwave Wireless Components Lett., 12, 473 (2002).

However, each one of the cited references suffers from at least one of the following disadvantages: excessive size, excessive cost, limited functionality, fabrication difficulties.

For the foregoing reasons, there is a need for high frequency magnetic MMIC filters that provide broader functionality and can still be manufactured on a very small scale using largely conventional fabrication techniques.

SUMMARY

The present invention is directed to a device that satisfies the need for a high frequency microstrip filter with broad functionality that can be made using largely conventional fabrication techniques. A device having features of the present invention comprises a microstrip device including a substrate, a first electrode layer, at least two layers of different high internal field/high resonance frequency materials, at least one layer of dielectric material between each layer of high internal field/high resonance frequency material, and a second electrode layer. Various embodiments of the invention solve the aforementioned problems related to magnetic MMIC filters in the 5-100 GHz range. However, according to other embodiments of the invention, the operation could be anywhere in the 5 GHz to 50 THz range depending on choice of materials According to different embodiments of the invention, there is at least one layer of dielectric material between the first electrode layer and the bottom layer of high internal field/high resonance frequency material or between the second electrode layer and the top layer of high internal field/high resonance frequency material. According to different embodiments of the invention, at least one layer of high internal field/high resonance frequency material is comprised of either ferromagnetic material, ferrites, magnetic alloys, antiferromagnets, hexagonal ferrites, exchange coupled multilayer materials, magnetic multilayer materials, other magnetic materials, left-handed metamaterials, and combinations thereof.

According to different embodiments of the invention, a variety of devices are anticipated. At its most basic level, electromagnetic waves propagate through the device, and ranges of frequencies of the electromagnetic waves are filtered. According to different embodiments, electromagnetic waves propagate through the device, and the application of an external magnetic field modifies the manner in which such electromagnetic waves propagate. According to different embodiments, electromagnetic waves propagate through the device, and the application of an external magnetic field modifies the ranges of frequencies of those waves which are filtered.

BRIEF DESCRIPTION OF THE DRAWINGS

The drawings are informal drawings, made for purposes of examination. The drawings are readable, and can be effectively scanned and adequately reproduced for publication purposes. Embodiments of the present invention are illustrated by way of example, and not by way of limitation, in the figures of the accompanying drawings and in which like reference numerals refer to similar elements and in which:

FIG. 3 shows a table illustrating a summary of design performance and parameters, and physical parameters, according to one embodiment of the invention.

FIG. 5 shows a table illustrating a comparison of experimental and theoretical results for FMR frequencies, according to different embodiments of the invention.

DETAILED DESCRIPTION

Techniques, systems, devices and methods related to microstrip filter devices are described. Broadly stated, embodiments of the present invention address the structure of high frequency filter devices, and the application of a variable magnetic field on the microstrip device in order to modify the ranges of frequencies to be filtered.

In the following description, for the purposes of explanation, numerous specific details are set forth in order to provide a thorough understanding of embodiments of the present invention. It will be apparent, however, to one skilled in the art that embodiments of the present invention may be practiced without some of these specific details. In other instances, well-known structures and devices are discussed and utilized.

While, for convenience, embodiments of the present invention may be described with specific layered structures and the application of a variable magnetic field to modify the ranges of frequencies to be filtered, the present invention is equally applicable to various other current and future applications. Such applications include a variety of tunable and non-tunable low-pass, high-pass, and band-pass filters of variable tuning ranges and frequencies, as well as delay lines, quarter wave length lines, phase shifters, and magnetic switches.

I. Microstrip Layers

Figure 1:
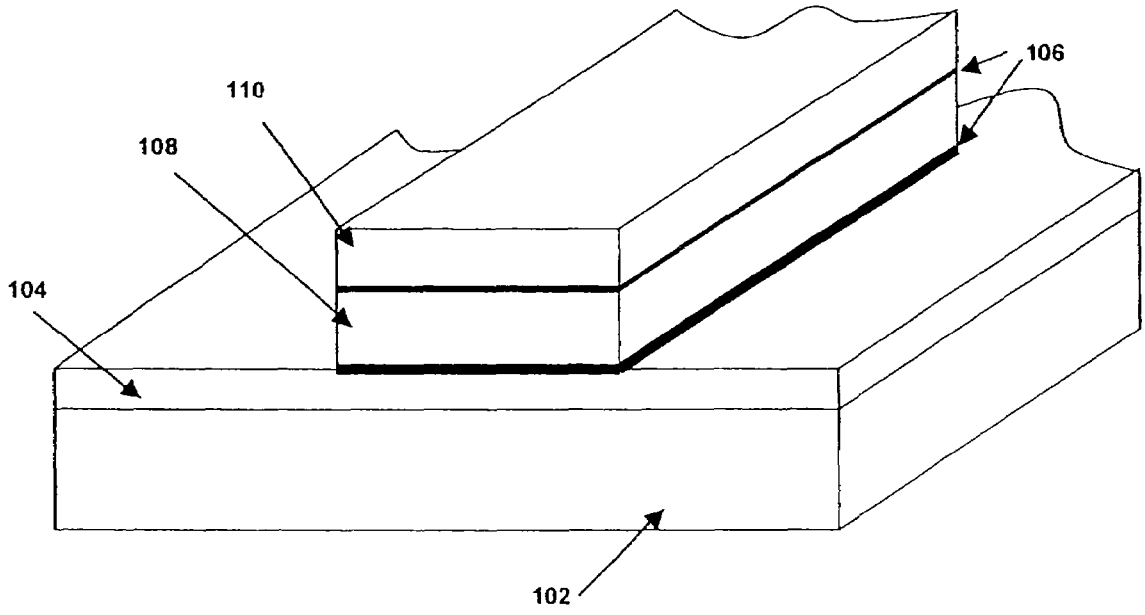
FIG. 1 shows a schematic diagram illustrating the layered structure of the microstrip device according to different embodiments of the invention.

This invention encompasses a novel layered structure for a microstrip device. One embodiment of the device concept is schematically shown in FIG. 1. The microstrip is comprised of a substrate 102, a first electrode layer 104, at least two layers 106 of different high internal field/high resonance frequency materials overlying the first electrode layer, at least one layer 108 of dielectric material between each layer of high internal field/high resonance frequency material, and a second electrode layer 110 overlying the top layer of high internal field/high resonance frequency material. According to different embodiments of the invention, the ranges of frequencies to be filtered can be modified with the application of a variable external magnetic field.

A. Substrate: Regarding the device geometry, the first layer of the microstrip device is the substrate 102. The substrate shall be comprised of a material that is microwave or millimeter wave friendly. Appropriate materials include: low conductivity glass, III-V compounds, mixed III-V compounds, II-VI compounds, mixed II-VI compounds, and combinations thereof. According to different embodiments of the invention, specific materials that may be appropriate include: GaAs, AlGaAs, InP, InGaAs, InGaP, ZnSe, and ZnSeS. Additional materials that may be appropriate include Si, and other low loss, microwave suitable substrates such as Teflon, plastic, and low conductivity rubber. According to different embodiments of the invention, the substrate is comprised of GaAs, and the thickness of the substrate is about 0.5 mm.

B. First Electrode Layer: Overlying the substrate, there is a first electrode layer 104. The electrode layer is comprised of a high conductivity metal. According to different embodiments of the invention, the electrode layer shall be comprised of Ag, Cu, Au, Pt, or Pd, or a combination thereof. According to different embodiments of the invention, the electrode layer is comprised of Ag, and the thickness of the layer is about 2 μm.

C. High Internal Field/High Resonance Frequency Material Layers: Overlying the electrode layer, there are at least two layers 106 comprised of different high internal field/high resonance frequency materials. For purposes of this entire application, including the claims, "high internal field/high resonance frequency material" is defined as follows: ferromagnetic material, ferrites, magnetic alloys, antiferromagnets, hexagonal ferrites, exchange coupled multilayer materials, magnetic multilayer materials, other magnetic materials, and combinations thereof, that have an internal field greater than 1 kOe, and a resonance frequency (in light of the geometry of the proposed layer) greater than 5 GHz when no external field is applied. The term "high internal field/high resonance frequency material" also includes left-handed metamaterials a resonance frequency (in light of the geometry of the proposed layer) greater than 10 GHz when no external field is applied Antiferromagnets, hexagonal ferrites, and exchange coupled multilayer materials can have extremely large internal fields. These "built in" fields, like an applied field, increase the resonance frequency. For example, hexagonal ferrites can have an extremely large uniaxial or easy plane magnetocrystalline anisotropy. The corresponding effective anisotropy field $H_A$ in Barium Hexaferrite (BaM) can be 18 kOe. Such large internal fields allow operation in the 50-75 GHz range with the application of little or no external fields. An alternative is use artificially structured left handed metamaterials for higher frequencies. Left handed metamaterials are structures that can be characterized as having a negative index of refraction.

The actual devices constructed thus far for this invention have used layers of high internal field/high resonance frequency material comprised of Fe, Permalloy (hereinafter "NiFe"), or multilayer Fe/Cu films. According to different embodiments of the invention, NiFe comprises a first layer of the high internal field/high resonance frequency material, and Fe comprises a second layer of the high internal field/high resonance frequency material. According to different embodiments of the invention, the thickness of a NiFe layer is about 140 nm, and the thickness of the Fe layer is about 70 nm.

D. Dielectric Layers: Between each layer of high internal field/high resonance frequency material, there shall be at least one layer of dielectric material 108. The dielectric layer shall be comprised of material that is microwave or millimeter wave friendly, and has little or no absorption of electromagnetic waves in the applicable range of resonance frequencies. According to different embodiments of the invention, a dielectric layer between layers of high internal field/high resonance frequency material is comprised of $SiO_2$. According to different embodiments of the invention, the thickness of $SiO_2$ dielectric layer is about 4 μm.

According to different embodiments of the invention, there is at least one layer of dielectric material between the first electrode layer and the bottom layer of high internal field/high resonance frequency material or between the second electrode layer and the top layer of high internal field/high resonance frequency material. As above, the dielectric layer shall be comprised of material that is microwave or millimeter wave friendly, and have little or no absorption of electromagnetic waves in the 5-100 Ghz range.

E. Second Electrode Layer: Overlying the top layer of high internal field/high resonance frequency materials, there is a second electrode layer 110. This electrode layer shall be comprised of a high conductivity metal. According to different embodiments of the invention, this electrode layer shall be comprised of Ag, Cu, Au, or a combination thereof. According to different embodiments of the invention, this electrode layer is comprised of Ag, and the thickness of the layer is about 2 μm.

F. Other layers: According to different embodiments of the invention, additional layers not specified above may be added between specified layers to improve the functionality, durability, or other attributes of the device. According to different embodiments of the device, a layer comprised of Ti may be added between specified layers of the device for adhesive purposes.

II. Device Functionality

According to different embodiments of the invention, there is a wide array of functionality that can be accomplished with the device depending on the design choices. According to different embodiments of the invention, at its most basic level, electromagnetic waves propagate through the device, and ranges of frequencies of said waves are filtered without the application of any externally applied magnetic field. It is the applied external magnetic field which enables tunability in the device, but some applications may not require such tunability Tunability is an important feature for many applications. According to different embodiments of the invention, electromagnetic waves propagate through the device, and the application of an external magnetic field modifies the manner in which the waves propagate therein. According to different embodiments of the invention, the application of an external magnetic field modifies the ranges of frequencies of waves which are filtered by the device.

In light of the foregoing, a wide range of applications can be foreseen. Such applications include a variety of tunable and non-tunable low-pass, high-pass, and band-pass filters. Depending on the design choices, these devices can have a wide variety of tuning ranges and frequencies. For example, according to different embodiments of the invention, a single device could be designed to include a number of different band pass regions. Various embodiments of the invention solve the problems related to magnetic MMIC filters in the 5-100 GHz range. However, according to other embodiments of the invention, the operation could be anywhere in the 5 GHz to 50 THz range depending on choice of materials and geometry. By way of example, and not limitation, other applications include delay lines, quarter wave length lines, phase shifters, and magnetic switches.

III. Device Geometry & Performance

While the particular high internal field/high resonance frequency materials used in a microstrip device are the primary determinant of the ranges of frequencies to be filtered, the microstrip device geometry also plays a key role. According to different embodiments of the invention, the device is patterned by photolithography and dry etched, thereby producing a long narrow magnetic ribbon (the upper portion of the microstrip). The geometry of the magnetic material will have a significant influence the operational frequency.

According to different embodiments of the invention, and as illustrated in FIG. 1, the device geometry comprises: a GaAs substrate 102 with a thickness of about 0.5 mm, a first Ag electrode layer 104 with a thickness of about 2 μm overlying the substrate, a NiFe layer 106 with a thickness of about 140 nm overlying the first electrode layer, a $SiO_2$ dielectric layer 108 with a thickness of about 4 μm overlying the NiFe layer, a Fe layer 106 with a thickness of about 70 nm overlying the dielectric layer, and a second Ag electrode layer 110 with a thickness of about 2 μm overlying Fe layer. It is very important to note that the invention is by no means limited to the specific geometries set forth in this paragraph. This geometry is merely used to illustrate one of the many design options for the invention, and detail the performance of the device using these parameters.

The device specified in the previous paragraph was fabricated, and the details of the fabrication process are set forth later in the Specification. The device was designed to be a band-pass filter, as the different materials have different resonance frequencies. This results in two different regions where propagation is not allowed. The range of frequencies between the two transmission dips is effectively a band-pass region. According to different embodiments of the invention, different combinations of materials may be used in different devices to create low-pass filters, high-pass filters, and other band-pass devices. According to different embodiments, the invention would enable a device with multiple band-pass regions by using additional layers of magnetic materials in the microstrip device. According to different embodiments of the invention, the ranges of frequencies to be filtered will be tunable with an applied external magnetic field A description of the performance of the previously described filter follows. The device characterization was done by a vector network analyzer along with a micro-probe station. Noise, delay due to uncompensated transmission lines connectors, its frequency dependence, and crosstalk, which occurred in measurement data, were taken into account by performing through-open-line (TOL) calibration using NIST Multical® software. The DC bias magnetic field was applied along the length of the microstrip line. The microstrip operated in a TM mode which ensured the ferromagnetic resonance condition, as the RF magnetic field and the DC magnetic field are perpendicular to each other.

Figure 2:
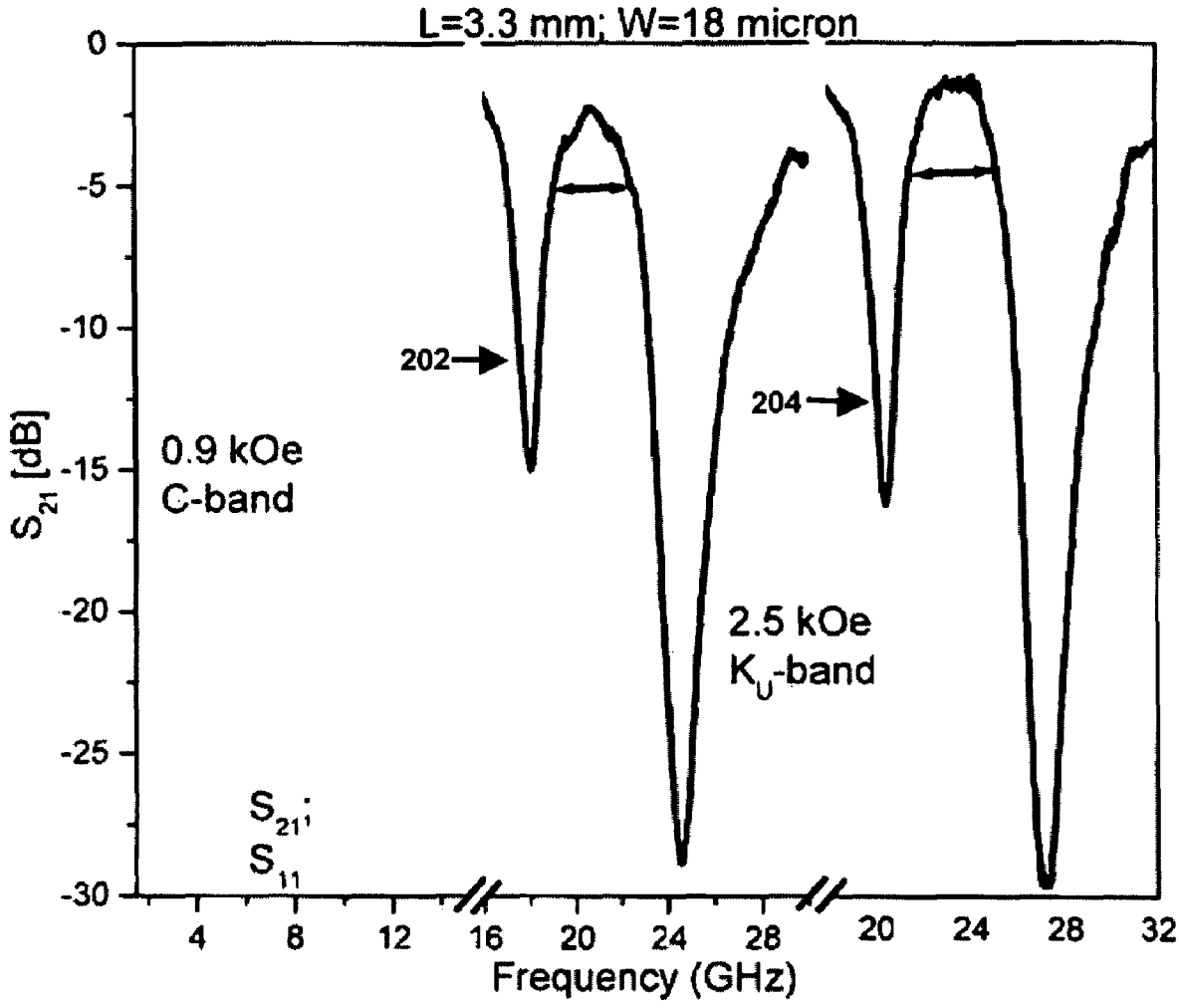
FIG. 2 shows a graph which illustrates the transmission characteristics of the device, according to one embodiment of the invention.

FIG. 2 shows the experimental $S_{21}$ response the band-pass filter with length of 3.3 mm and width of 18 μm. The applied field on the left 202 was 2.5 kOe. As discussed above there two distinct attenuation regions and in between there is a band pass region. The position of the notches at either side of the pass band occurs at the frequencies given by the ferromagnetic resonance condition and is tunable with the external field. The applied field on the right 204 shows the experimental $S_{21}$ response for the same structure at an applied field of 3.5 kOe. Clearly the band-pass region has moved, almost as a single unit, to higher frequencies.

The frequency tunability of the filter may be defined as:

$$\frac{f_c(\text{max field}) - f_c(\text{zero field})}{f_c(\text{zero field})} \times 100\,\%,$$

where $f_c$ is the center frequency of the filter. As the bias magnetic field was varied from 0.03 to 3.26 kOe, the center frequency varied from 4 to 24 GHz giving a maximum frequency tunability of 500%. The structure of the filter resulted in an extremely low reflection ($S_{11}$ is less than −15 dB) at the pass-band region. The filters exhibited clean pass-band response and high out-of-band rejection in the frequency range near the pass band region. According to different embodiments of the invention, the range of frequencies to be rejected could be modified by adding additional layers of different materials or modifying the device geometry. Such alternatives are addressed in detail later in the Specification.

There are additional methods to parameterize the performance of this band-pass filter. The key parameters are listed in the table of FIG. 3. It is important to note that the band-pass filter can be tuned to different frequencies without changing the width of the band-pass region, which stayed around 3+/−0.5 GHz. Filters with constant bandwidth have practical applications where a number of different center frequencies are needed.

Figure 4:
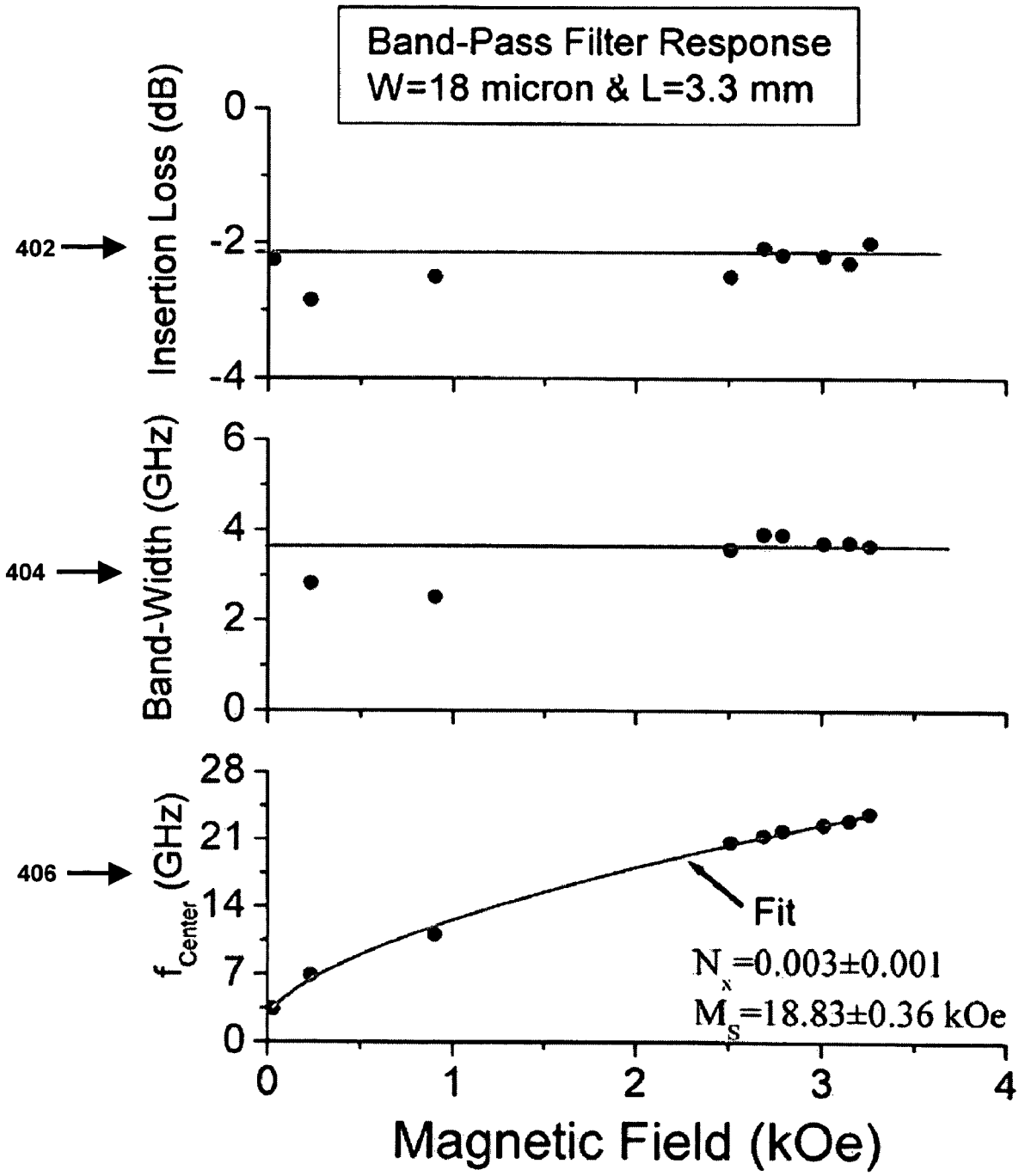
FIG. 4 shows a series of graphs which illustrate the insertion loss, bandwidth, and center frequencies, according to one embodiment of the invention.

The graphs of FIG. 4 show the pass-band insertion loss 402, 3-dB bandwidth 404 and center frequency 406 as a function of biasing magnetic field. The pass-band insertion loss 402 was −2+/−0.5 dB, which is in the tolerable range for a device to perform. The 3 dB bandwidth 404 of the filter was about 21% of the central frequency when H=0.9 kOe, about 17.5% when H=2.5 kOe, and 15.7% when H=3.26 kOe. The relative differential frequency of Fe and NiFe was almost constant over the entire biasing field range. This explains why the bandwidth of the filter is almost constant (small increase with increasing field). The center frequency $f_c$ 406 of the filter follows a regular pattern with respect to applied magnetic field. This is mostly in accordance with the equation for the FMR condition. The solid line is a fit to the experimental data, which gives a relative $4\pi M_s$ value and the demagnetization factor $N_x$ for this device.

The use of Fe and NiFe in the same device, and the performance of the fabricated device, demonstrates the feasibility of magnetically tunable band-pass planar microwave filters. High frequency operation, tunability, and an almost constant 3 dB pass-band bandwidth over the entire frequency range are important benefits of this embodiment. The absorption of a magnetic material at resonance depends on the thickness of the film, in addition to the resonance linewidth and the width of the magnetic strip. Such issues are addressed below.

III. Device Geometry Options & Performance Tradeoffs

A. Device Geometries: Different geometries of the microstrip can have an impact on the ranges of frequencies to be filtered. For this reason, it is illustrative to examine a number of different microstrip device geometries using Fe or NiFe as the active elements. Although these devices differ from the invention because there is only one layer of magnetic material in the device, the results still are informative regarding the effect of shape anisotropy in different embodiments of the invention.

The performance of different device geometries was evaluated using a vector network analyzer. The microstrip transmission lines were characterized at frequencies from 1 to 40 GHz using an automated vector network analyzer, and a microprobe station. The on wafer through-open-line (TOL) calibration using NIST Multical® software ensures the removal of coaxial-to-microstrip transition losses, and losses due to electronic components and cables etc. Therefore, the studied transmission coefficient is the true forward $S_{21}$ scattering term of the filter.

The frequency of operation was significantly altered by changing the geometry-thickness (t), width (W) and length (L) of the magnetic element in the microstrip. The magnetic material was in the form of a long ribbon with the following dimensions: lengths L of 2.2, 3.3, and 6.6 mm; widths W of 12, 18, and 26 μm; and thicknesses t of 0.3 to 0.35 μm. A static magnetic field H was applied in the z direction along the length of the microstrip. The microstrip was operated in a transverse magnetic (TM) mode so a fluctuating microwave magnetic field $h_{rf}$ is oriented perpendicular to the static field and parallel to the width of the micros trip in the y direction. This arrangement ensured a strong interaction between the microwave energy and the ferromagnetic film.

The effect of the shape anisotropy on the operational frequency can be estimated. As the magnetization precesses, dynamic magnetic poles are generated at the surfaces and sides of the ferromagnetic ribbon. This leads to dynamic demagnetizing fields which can influence the precession frequency. The theoretical resonance frequency for a ribbon shaped magnetic element is calculated from the following resonance condition:

$$f=\gamma\sqrt{(H+H_\alpha+(N_y-N_z)4\pi M_s)(H+H_\alpha+(N_x-N_z)4\pi M_S)}.$$

The operational frequency depends on the material properties, such as saturation magnetization $M_s$, anisotropy fields $H_\alpha$, the gyromagnetic ratio γ, and the magnitude of an applied field H. The demagnetizing factors $N_x$. $N_y$, and $N_z$ may be approximated for a rectangular parallelepiped. $N_x$ is the demagnetizing factor governing the demagnetizing fields perpendicular to the surface of the microstrip, $N_z$ governs the demagnetizing fields along the length of the microstrip and $N_y$ is associated with the demagnetizing fields along the width of the microstrip.

For an extended film $N_x=1$ and $N_y=N_z=0$, and the usual ferromagnetic resonance condition for a thin film is thus:

$$f=\gamma\sqrt{(H+H_\alpha)(H+H_\alpha+4\pi M_S)},$$

In the absence of anisotropy fields, the operational frequency is zero at zero applied field. In contrast, a resonance frequency was observed of about 4 GHz for the NiFe based devices and a resonance frequency was observed of up to 11 GHz for the Fe based devices. This is a substantial boost in operational frequency of a planar microwave device.

In the microstrip geometry, $N_x \approx 1-N_y$ and $N_z \approx O$. The important difference between the film geometry and the microstrip geometry is that $N_y$ is not zero in the microstrip. This increase in the value of $N_y$ ultimately leads to an increase in the operational frequency over that predicted by the thin film resonance condition. The values of $N_y$ are given in the table in FIG. 5 for the different geometrical structures; the changes in demagnetizing factors completely explain the shifts in resonance frequency. FIG. 5 shows a table comparing experimental and theoretical results for FMR frequencies as a function of line width and line length, and the results are discussed in greater depth below.

Figure 6:
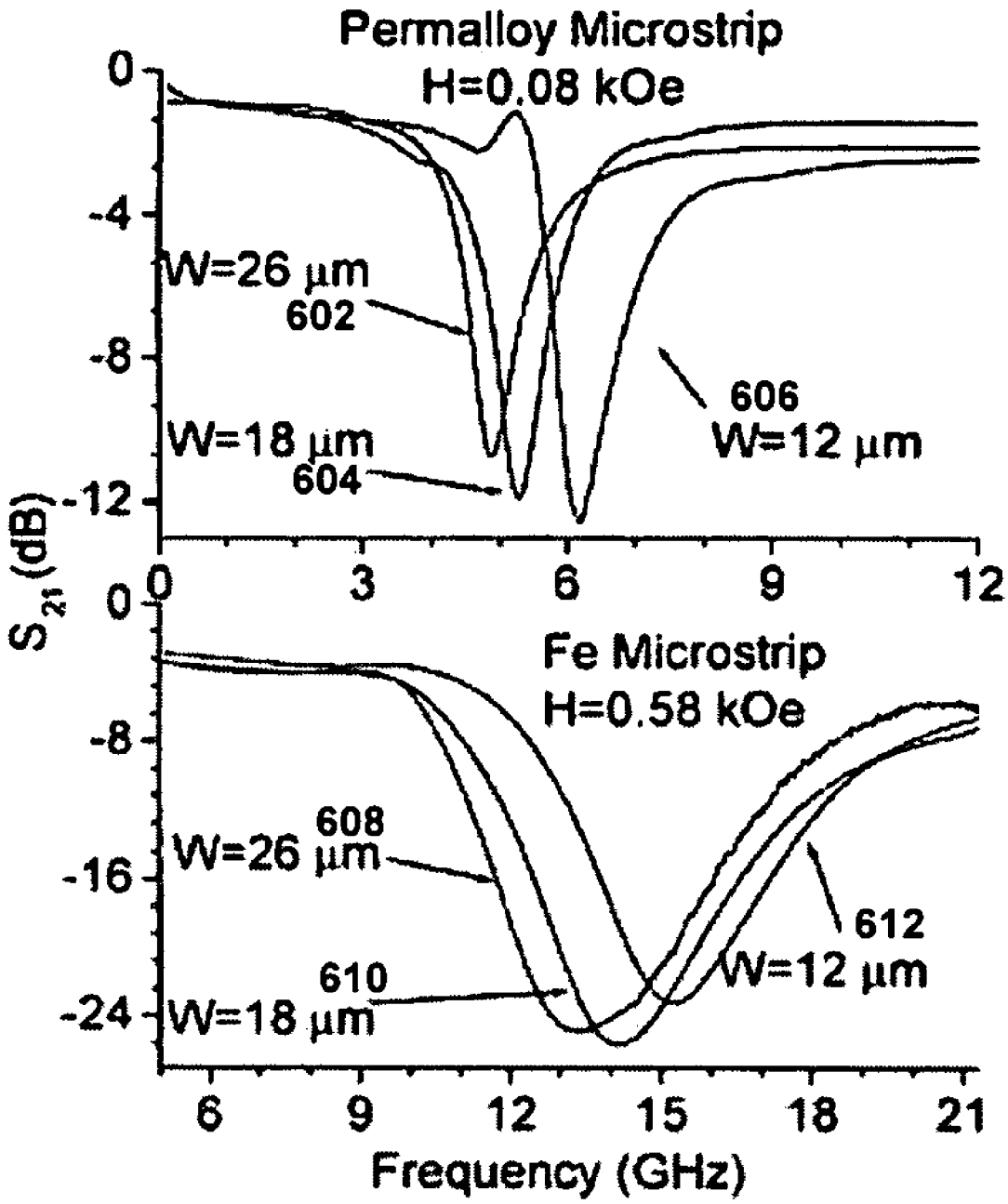
FIG. 6 shows graphs which illustrate the transmission characteristics using different microstrip widths.
Figure 7:
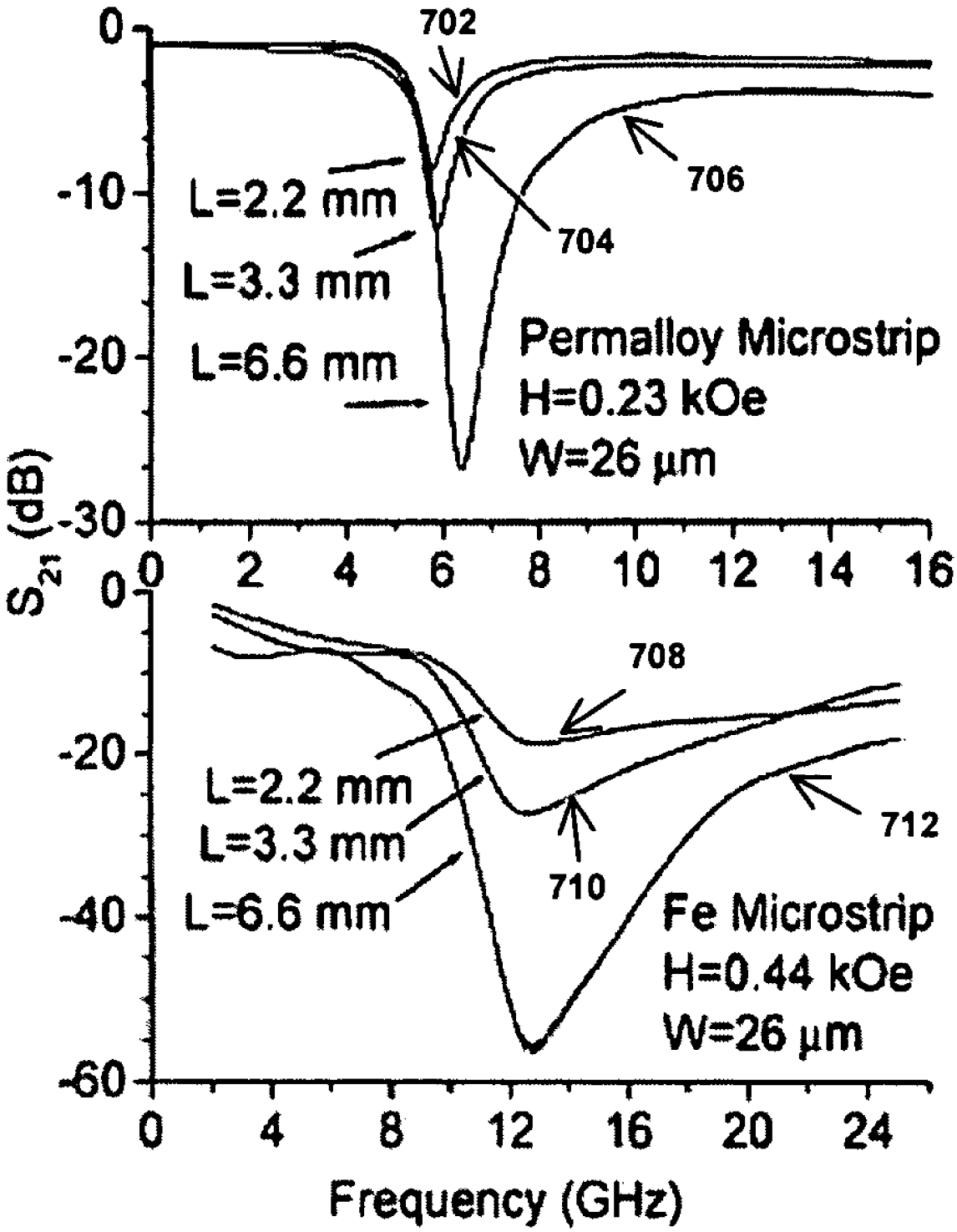
FIG. 7 shows graphs which illustrate the transmission characteristics using different microstrip lengths.

The stop-band frequencies for NiFe and Fe structures with different linewidths and line-lengths are graphically shown in FIGS. 6 and 7, respectively, at a fixed static magnetic field. FIG. 6 illustrates the transmission response of 3.3 mm long NiFe (upper panel) and Fe (lower panel) based filters as a function of frequency for different line-widths (W) of the magnetic element. In the upper panel, the responses for line widths of 26 μm 602, 18 μm 604, 12 μm 606 are illustrated; in the lower panel, the responses for line widths of 26 μm 608, 18 μm 610, 12 μm 612 are illustrated. It is clear from FIG. 6 that a narrower strip width results in a higher FMR frequency. This is consistent with theoretical expectations since $N_y$ increases as the strip width decreases, thereby increasing the resonance frequency. The widest microstrips seem to have the largest linewidths, and one way to reduce the linewidth is to make the width of the microstrip narrower. The insertion loss (2-3 dB for the NiFe filters and 3-5 dB for the Fe filters) is also not strongly dependent on the width of the magnetic element. The power attenuation is close to 60 dB/cm for the NiFe devices and dramatically larger for Fe, with values at the higher frequencies close to 90 dB/cm. Inside the stop-band the reflection coefficient is better than −15 dB. The stop-band frequency range for the NiFe filter is about 2 GHz, and for Fe it is about 6 GHz.

FIG. 7 illustrates the transmission parameter of 26 μm wide NiFe (upper panel) and Fe (lower panel) based filters as a function of frequency for different line-lengths (L) of the magnetic element. In the upper panel, the responses for line-lengths of 2.2 mm 702, 3.3 mm 704, and 6.6 mm 706 are illustrated; in the lower panel, the responses for line-lengths of 2.2 mm 708, 3.3 mm 710, and 6.6 mm 712 are illustrated. The FMR frequency is nearly independent of the length of the microstrip. This is consistent with theoretical calculations because the $N_y$ coefficient increases very slightly with an increase of line length. The increase of L does, however, increase absorption as expected. Again, the linewidth does not follow a clear pattern as a function of thickness. However, the smallest linewidths seem to occur for the longest lines.

A comparison of experimental and theoretical FMR frequencies is given in FIG. 5. The agreement for both the Fe and NiFe based devices is excellent when the width of the microstrip is changed. Also, as expected, the experimental results for the Fe-based devices did not show much variation of FMR frequency as a function of the line length. In contrast, a small but distinct change in the FMR frequency was measured in the NiFe-based devices as the length was increased. This may have been due to a slight non uniformity in the applied field which would shift the frequency up slightly for a longer structure. The experimental setup produced a biasing field which was nearly uniform over a distance of 2 mm. For the longer devices, with a length of 6 mm, the static magnetic field at the ends of the device was approximately 20% larger than the field at the center. This small variation could lead to an increase in frequency as L is increased in the NiFe devices. Assuming an increase of 10% in the average field, the frequency would be increased by about 0.15 GHz, and this explains some of the increase in frequency as the length was increased. There was also a small increase in the longer Fe-based devices. If 10% increase is assumed in the average field for the long Fe-based devices, a frequency of 12.69 GHz is obtained, which matches the experimental result.

For a given device, the width of the attenuation dip becomes distinctly narrower as the applied field is increased and the resonance moves to higher frequencies. This behavior is surprising because it would normally be expected that the effective damping in the spin equations of motion would be proportional to the frequency, and the linewidth in an FMR experiment is proportional to the damping. This narrowing of the width of the attenuation peak is consistent with theoretical results. The large linewidth at low frequencies can be substantially reduced by narrowing the width of the microstrip.

The considerable enhancement of the resonance frequency of the device is achieved by narrowing the width (W) of the magnetic film. Indeed, the resonance frequency is a function of the demagnetizing factors which are directly related to the width, length, and thickness of the device. In the ideal case, the magnetic film would be structured to have a nearly square cross section. This would introduce demagnetizing fields that can substantially increase the operational frequencies at low bias fields, while also narrowing the linewidth. One way to create a square cross section would be to increase the thickness of the magnetic material. However, this would significantly increase the losses due to eddy currents. Based on the foregoing, one skilled in the art has the necessary information to optimize the design to achieve high operational frequencies at low external field. The discussion sets forth the issues to be considered when designing the geometry for different embodiments of the invention.

B. Linewidth: There are additional design issues to consider, such as linewidth optimization. According to different embodiments of the invention, multilayered materials are used as one of the high internal field/high resonance frequency material layers. It is illustrative to compare the linewidths when using Fe (100 nm thickness) as the active element to the linewidths using a Fe(5 nm)/Cu (0.8 nm) multilayer structure (116 nm thickness). Such devices were fabricated in the same manner, and had the same geometry, except that the layer of magnetic material (Fe v. Fe/Cu) was different in each. Although these devices differ from the invention because there is only one layer of magnetic material in each device, the results still are informative regarding the design considerations and linewidth characteristics of multilayered material in different embodiments of the invention.

Figure 8A:
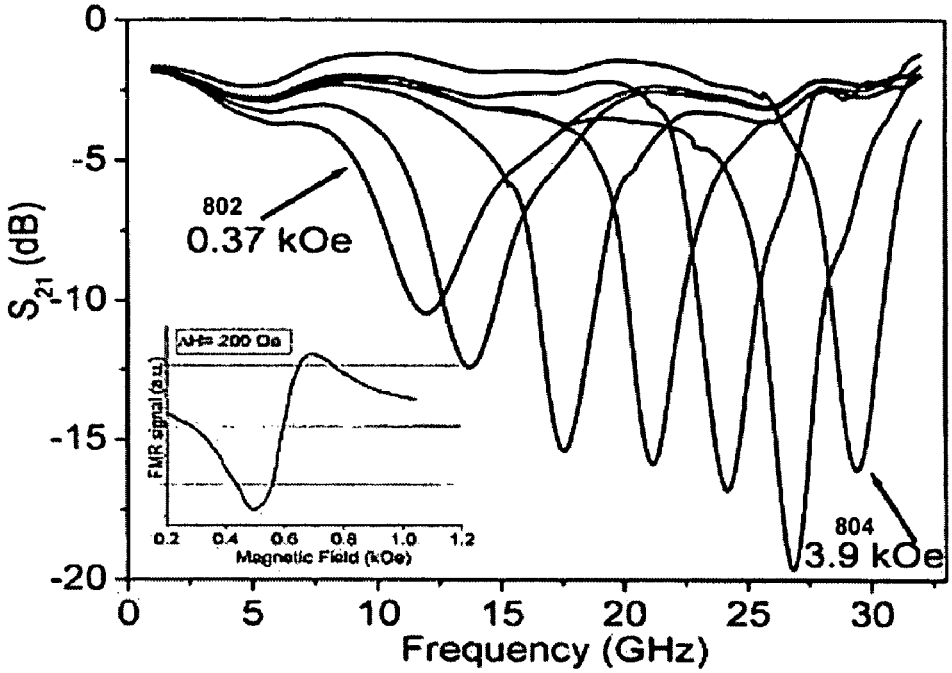
FIGS. 8(*a*) and 8(*b*) show graphs which illustrate different linewidths applicable to a continuous Fe film versus a Fe/Cu multilayered structure.
Figure 8B:
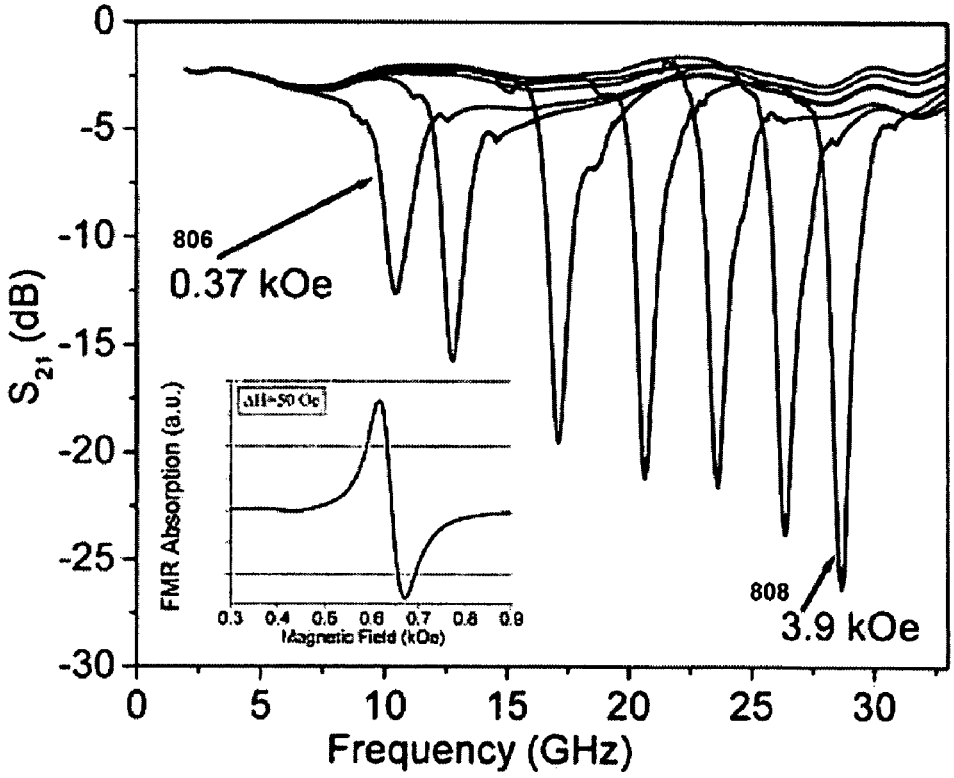
Figure 9:
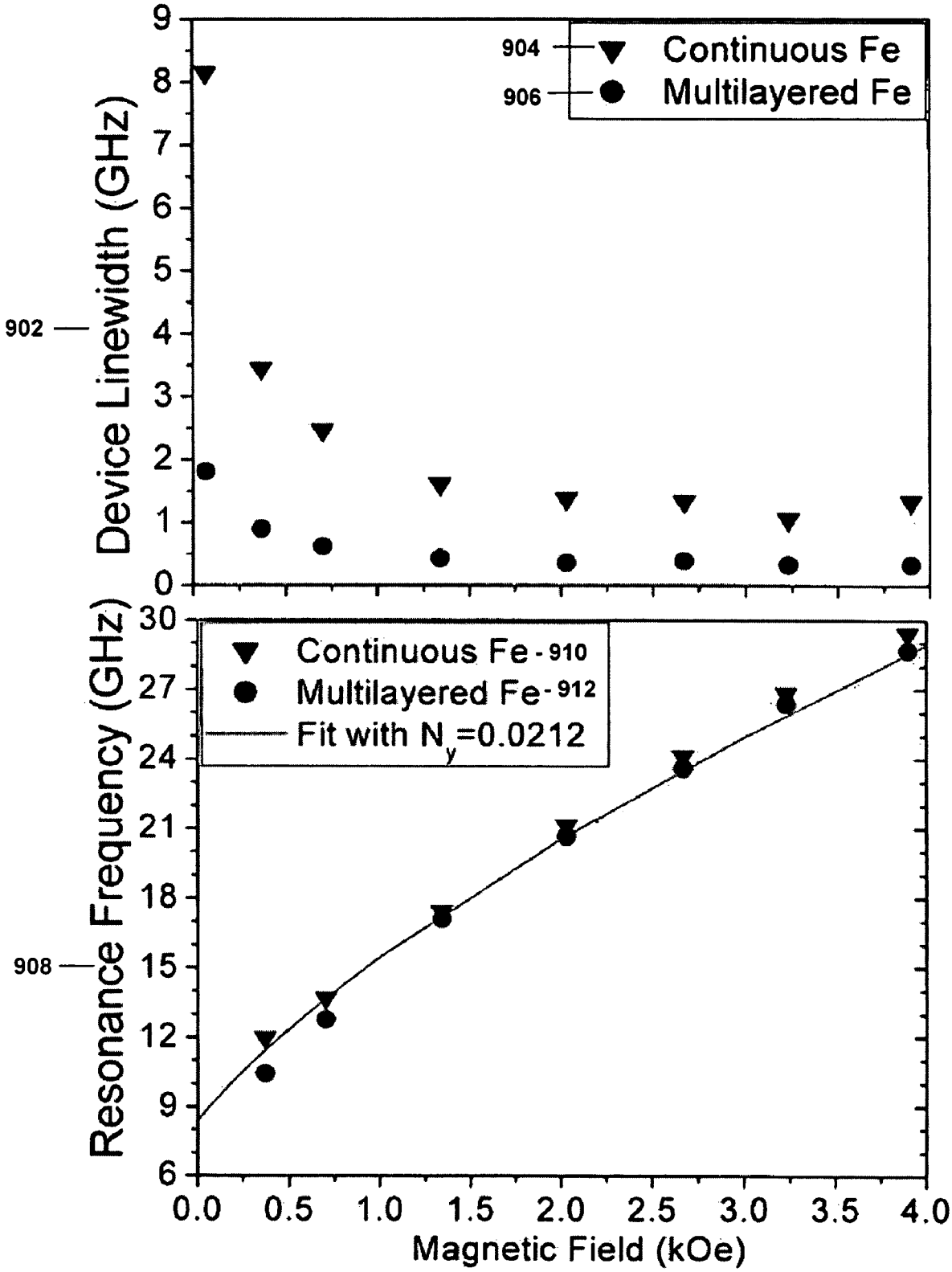
FIG. 9 shows graphs which illustrate the linewidths and FMR applicable to a continuous Fe film versus a Fe/Cu multilayered structure, with various applied magnetic fields.

FIG. 8(*a*) shows the transmission characteristics of the continuous Fe film, with the applied field varying from 0.37 kOe 802 to 3.9 kOe 804. FIG. 8(*b*) shows the transmission characteristics of the Fe/Cu multilayer structure, again with the applied field varying from 0.37 kOe 806 to 3.9 kOe 808. The stop-band bandwidth (i.e. linewidth) is reduced from 5 GHz for the continuous Fe film, to 2 GHz for the Fe/Cu multilayered structure. The multilayer material could be used to address RF interference problems, providing a narrow linewidth with a transition to stop-band of only a few hundred MHz. FIG. 9 illustrates the magnetic field dependence of linewidth using the different films. The upper panel 902 of FIG. 9 compares the linewidth of the continuous Fe film 904 and the Fe/Cu multilayered film 906 at different applied fields. The lower panel 908 of FIG. 9 compares the resonance frequency of the continuous Fe film 910 and the Fe/Cu multilayered film 912 at different applied fields. The considerable narrowing of the linewidth was due to the breaking of Fe films by Cu interlayers to reduce the typical grain size. According to different embodiments of the invention, different high internal field/high resonance frequency material layers can be used in one device to create different types of filters: low-pass, high-pass, band-pass, band-stop, and combinations thereof. Understanding how linewidths can be modified by using different materials can aid in the design process. This information is not offered to prove that all such multilayer materials will necessarily result in narrower linewidths, merely to suggest that this is a relevant design criteria.

Figure 10:
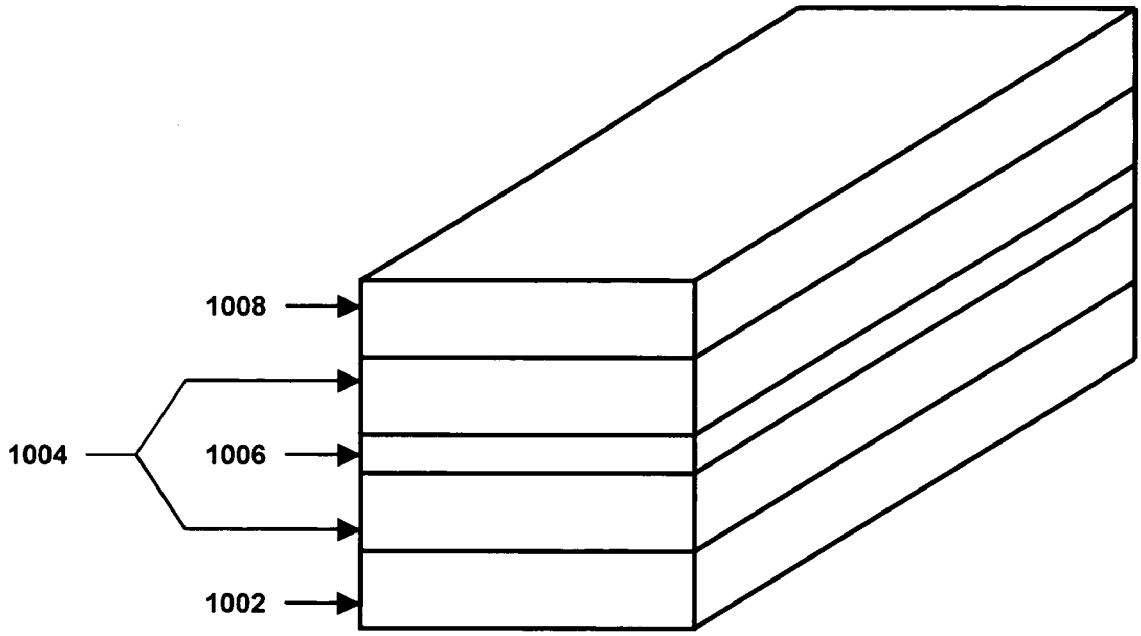
FIG. 10 shows a schematic diagram illustrating the design of layered structure of the microstrip device where the ferromagnetic material is surrounded on both sides by dielectric material

C. Position Adjustment of High Internal Field/High Resonance Frequency Material Layers: Other design issues to consider include the effect of adjusting the position of the magnetic layers. In this case, only the results of a numerical model are presented. However, such results are presented to aid one skilled in the art is considering different device geometries. According to different embodiments of the invention, the high internal field/high resonance frequency material layers may be surrounded on both sides by dielectric material, instead of being directly adjacent to the first or second electrode layer. It is illustrative to compare the modeled performance of a device where Fe comprises the only high internal field/high resonance frequency material layer, yet is placed in different positions. In one model, the Fe layer is directly adjacent to an electrode layer. In a second model, illustrated in FIG. 10, the Fe layer 1006 is surrounded on both sides by dielectric material 1004. There are also electrode layers on the bottom 1002 and top 1008, similar to the corresponding electrode layers of different embodiments the invention. Different models between the extremes are examined as well. Although such devices differ from the invention because there is only one layer of magnetic material in each device, the results still are informative regarding the design considerations relating to the position of the magnetic layer in different embodiments of the invention.

Figure 11:
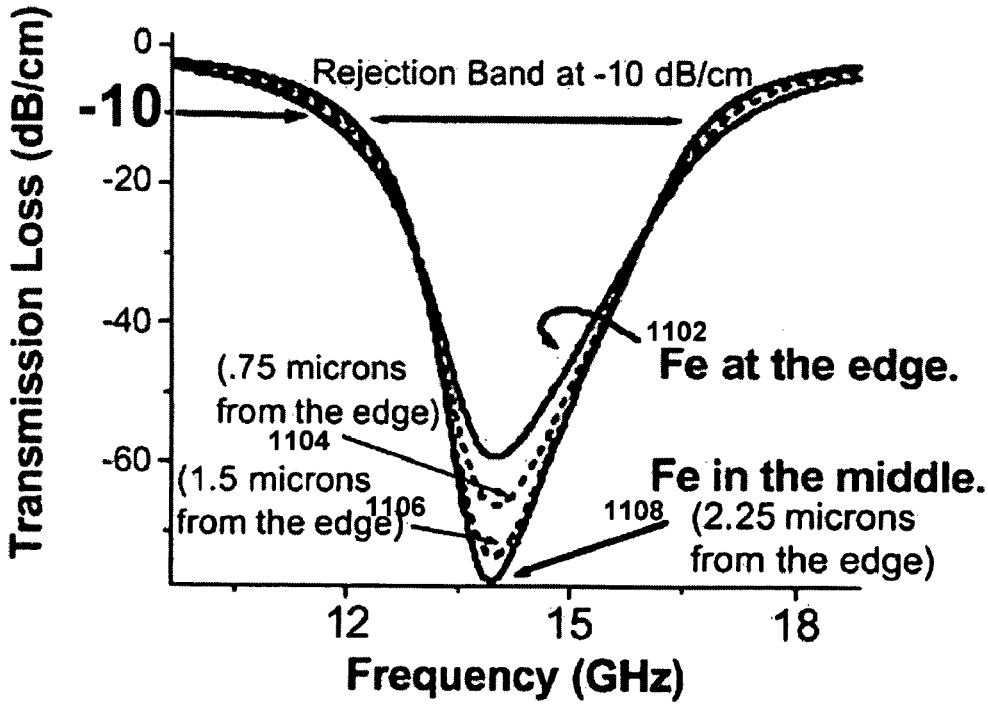
FIG. 11 shows a graph which illustrates the different transmission characteristics when the active ferromagnetic material in a microstrip device is placed in different positions.

In the graph in FIG. 11, the transmission loss of a wave was plotted as a function of frequency for a set of filters where the Fe film is placed in different positions. The total thickness of the two dielectric layers in each of the models is 4.5 μm. The graph illustrates the transmission loss when the Fe film is at the edge 1102, 0.75 μm from the edge 1104, 1.5 μm from the edge 1106, and 2.25 μm from the edge 1108. The graph illustrates that the largest attenuation occurs at the resonance frequency, regardless of the position of the Fe. Among the different designs, the largest attenuation occurs when the magnetic film is positioned directly in the middle 1108 of the waveguide with equal amounts of dielectric on each side. According to the models, placing the magnetic film directly in the middle produces a deeper attenuation and a narrower peak compared to different positions. According to different embodiments of the invention, the high internal field/high resonance frequency material layers may be surrounded on both sides by dielectric material, instead of being directly adjacent to the first or second electrode layer. Understanding how adjusting the position of the magnetic layers might produce deeper attenuation and a narrower peak can aid in the design process. This modeling is not offered to prove that such position changes will necessarily result in deeper attenuation and a narrower peak, merely to suggest that this is a relevant design criteria.

V. Fabrication

Different embodiments of the invention were fabricated. The fabrication of the device specified in paragraph 45 will be addressed in detail. The specifics of the fabrication are provided to enable one skilled in the art to fabricate certain embodiments of the invention. The information provided in no way limits the different methods in which the invention can be fabricated. With the geometry specified in paragraph 45, different structures were grown in a sputtering system with a background pressure maintained at ~$2\times10^{7}$ Torr. A GaAs substrate was first cleaned in an ultrasonic bath, and then it was annealed to 200° C. inside the vacuum chamber.

All the depositions were done at room temperature. First, a Ti layer with a thickness of about 5 nm was added for good adhesion to the substrate. Then, an Ag layer with a thickness of about 2 μm was added, which was used as the ground plane for the device. This layer is referred to elsewhere as the first electrode layer.

The next sequence of depositions was made through a shadow mask. The first magnetic layer, NiFe, was deposited with a thickness of about 140 nm. This layer is referred to elsewhere as a layer high internal field/high resonance frequency material. Then a dielectric layer of $SiO_2$ with a thickness of about 4 μm was deposited with an E-gun source. The second magnetic layer, Fe, was deposited with a thickness of about 70 nm. This layer is referred to elsewhere as a layer high internal field/high resonance frequency material. Finally, a second Ag layer with a thickness of about 2 μm was added, which was used as the signal line for the device. This layer is referred to elsewhere as the second electrode layer. The film was then patterned by photolithography, and then dry etched to obtain the required strip widths and lengths for the particular devices. It produced a long narrow magnetic ribbon, and the geometry of the ribbon which will impact the operation frequency as previously noted. Various embodiments of the device were fabricated, and the widths were between 5-24 μm, and had lengths between 2-6 mm.

As noted, the details of the fabrication sequence are meant to enable one skilled in the art to fabricate various embodiments of the device. They in no way limit the device geometries, growth methods, or lithography techniques that may be employed to create different embodiments of the device. For example, the device was grown by magnetron sputtering, a well known technique widely used in the industry. Most of previous magnetic MMIC devices were grown with Molecular-beam epitaxy (MBE). MBE films are generally less than 100 nm, and more costly to produce. The sputtering technique can produce the thicker films at lower costs. However, either of these techniques, or any other techniques for that matter, may be used to fabricate the devices.

The invention claimed is:

1. A microstrip device comprising:

a substrate;

a first electrode layer overlying the substrate;

at least two layers of different high internal field/high resonance frequency materials overlying the first electrode layer;

at least one layer of dielectric material between each said layer of high internal field/high resonance frequency material; and a second electrode layer overlying a top layer of said layers of high internal field/high resonance frequency material.

2. The device in claim 1, wherein there is at least one additional layer of dielectric material between the first electrode layer and a bottom layer of said layers of high internal field/high resonance frequency material or between the second electrode layer and the top layer of said layers of high internal field/high resonance frequency material.

3. The device in claim 1, wherein there is at least one layer of adhesive material between at least two different layers of the device.

4. The device in claim 1, wherein the substrate comprises a material selected from the group consisting of: GaAs, AlGaAs, InP, InGaAs, InGaP, ZnSe, and ZnSeS.

5. The device of claim 1, wherein the first or second electrode comprises a material selected from the group consisting of: Ag, Cu, Au, Pt, Pd, and combinations thereof.

6. The device of claim 1, wherein at least one layer of said layers of high internal field/high resonance frequency material comprises a material selected from the group consisting of: ferromagnetic material, ferrites, magnetic alloys, magnetic multilayer materials, other magnetic materials, and combinations thereof.

7. The device of claim 1, wherein a first layer of said layers of high internal field/high resonance frequency material comprises NiFe, and a second layer of said layers of high internal field/high resonance frequency material comprises Fe.

8. The device of claim 1, wherein electromagnetic waves propagate through said device, and ranges of frequencies of said waves are filtered thereby.

9. The device of claim 1, wherein electromagnetic waves propagate through said device, and an application of an external magnetic field modifies the manner in which said waves propagate through said device.

10. The device of claim 9, wherein said application of said external magnetic field modifies one or more ranges of frequencies of said waves which are filtered by said device.

11. A microstrip device comprising:

a GaAs substrate;

a first Ag electrode layer overlying the substrate;

a NiFe layer overlying the first electrode layer;

a $SiO_2$ dielectric layer overlying the NiFe layer;

a Fe layer overlying the dielectric layer; and a second Ag electrode layer overlying the Fe layer.

12. A method of filtering ranges of frequencies of electromagnetic waves, said method comprising the steps of:

(a) providing at least one electromagnetic wave;

(b) passing at least one of said waves through a microstrip device comprising (i) a substrate;

(ii) a first electrode layer overlying the substrate;

(iii) at least two layers of different high internal field/high resonance frequency materials overlying the first electrode layer;

(iv) at least one layer of dielectric material between each said layer of high internal field/high resonance frequency material; and (v) a second electrode layer overlying a top layer of said layers of high internal field/high resonance frequency material.

13. The method of claim 12, further comprising:

modifying a magnetic field applied to said microstrip device to change one or more of the ranges of frequencies to be filtered.

14. The method of claim 13, wherein the one or more of the ranges of frequencies comprises a band-pass region.

15. The method of claim 14, wherein the modification of the magnetic field cause the band pass region to move to higher frequencies.

16. A method of filtering variable ranges of frequencies of electromagnetic waves, said method comprising the steps of:

(a) providing at least one electromagnetic wave;

(b) passing at least one of said waves through a microstrip device comprising (i) a substrate;

(ii) a first electrode layer overlying the substrate;

(iii) at least two layers of different high internal field/high resonance frequency materials overlying the first electrode layer;

(iv) at least one layer of dielectric material between each said layer of high internal field/high resonance frequency material; and (v) a second electrode layer overlying a top layer of said layers of high internal field/high resonance frequency material;

(c) applying an external magnetic field to said microstrip device to modify the ranges of frequencies of said waves to be filtered.

17. The method of claim 16, further comprising:

modifying the external magnetic field applied to said microstrip device to change one or more of the ranges of frequencies to be filtered.

18. The method of claim 16, wherein said microstrip device comprises at least one of a low-pass filter, a high-pass filter, or a band-pass filter.

19. A method of forming a device, said method comprising the steps of:

(a) providing a microstrip device comprising (i) a substrate;

(ii) a first electrode layer overlying the substrate;

(iii) at least two layers of different high internal field/high resonance frequency materials overlying the first electrode layer;

(iv) at least one layer of dielectric material between each said layer of high internal field/high resonance frequency material; and (v) a second electrode layer overlying a top layer of said layers of high internal field/high resonance frequency material; and (b) coupling said microstrip device to a means for receiving electromagnetic waves.

20. A method of forming a device, said method comprising the steps of:

(a) providing a microstrip device comprising (i) a substrate;

(ii) a first electrode layer overlying the substrate;

(iii) at least two layers of different high internal field/high resonance frequency materials overlying the first electrode layer;

(iv) at least one layer of dielectric material between each said layer of high internal field/high resonance frequency material; and (v) a second electrode layer overlying a top layer of said layers of high internal field/high resonance frequency material, and (b) coupling said microstrip device to a means for receiving an external magnetic field, said means to enable an application of a variable external magnetic field to said device.

* * * * *